United States Patent [19]

Field

[11] 4,275,762

[45] Jun. 30, 1981

[54] CONTROL DAMPER

[75] Inventor: Sydney J. Field, Ashford, England

[73] Assignee: Actionair Equipment Limited, Whitstable, England

[21] Appl. No.: 67,820

[22] Filed: Aug. 20, 1979

Related U.S. Application Data

[63] Continuation of Ser. No. 862,920, Dec. 21, 1977, abandoned.

[30] Foreign Application Priority Data

Dec. 22, 1976 [GB] United Kingdom ..... 53581/76

[51] Int. Cl.[3] ..... F24F 13/14

[52] U.S. Cl. ..... 137/601; 98/121 A

[58] Field of Search ..... 98/110, 121 A; 137/601; 49/91, 92; 74/467

[56] References Cited

U.S. PATENT DOCUMENTS

| | | | |
|---|---|---|---|
| 1,872,599 | 8/1932 | LeGrand | 137/601 X |
| 3,084,715 | 4/1963 | Sharres | 137/601 |
| 3,281,113 | 10/1966 | Ahern | 137/601 X |
| 3,630,098 | 12/1971 | Oxley | 74/467 X |
| 3,771,559 | 11/1973 | Alley | 137/601 |
| 3,885,347 | 5/1975 | Adachi | 98/110 X |
| 3,908,529 | 9/1975 | McCabe | 98/110 |

*Primary Examiner*—Robert G. Nilson

*Attorney, Agent, or Firm*—Berman, Aisenberg & Platt

[57] ABSTRACT

A control damper for controlling the flow of air or other gaseous fluid through a duct, comprising a line of blades each of which is so supported for rotation in a surrounding frame that the blades are swingable about parallel axes to open or close an opening in the frame and to be movable at will to intermediate positions between their fully-open and fully-closed positions, in which the blades are of aerofoil shape.

4 Claims, 12 Drawing Figures

CONTROL DAMPER

This is a continuation of application Ser. No. 862,920 filed on Dec. 21, 1977, now abandoned.

This invention relates to control dampers for controlling the flow of air or other gaseous fluid through a duct. More specifically, it relates to control dampers of the kind comprising a line of blades which can be swung about parallel axes to open or close an opening in a frame supporting the blades, the frame being adapted to be mounted in or within a duct. The flow of air through the frame (and therefore through the duct) can thus be varied by varying the angle at which the blades are set.

In some control dampers of this general construction, the blades are linked together in such a way that they all move in unison with each other and always in the same direction or sense as each other. In other control dampers, the linkage between the blades is such that pairs of blades move towards and away from each other as the blades are rotated about their respective axes. In other words, adjacent blades move in opposite senses or directions to each other. The effect, however, in both forms of damper is the same, namely, that swinging movement of the blades about their axes moves them either towards their closed position or their open position.

The present invention is described herein as applied to control dampers of the second type mentioned above, i.e. dampers having pairs of blades which move towards and away from each other. It is to be understood, however, that the invention can also be applied to the first form of construction in which the blades move always in the same direction or sense as each other.

Many different forms of blade shapes have been proposed for control dampers of the construction outlined above. As far as we are aware, however, none of the control dampers so far devised and placed on the market has blades specifically designed to give the lowest possible resistance to air flow when the blades are in their fully-open positions, i.e. when they lie parallel to the air flow through the frame supporting them, or when they are in partially-open positions. The aim of the invention is, accordingly, to provide a control damper wherein the blades give less resistance to air flow through the damper, especially when they are in their fully-open position, than in the dampers used hitherto.

With this aim in view, the present invention is directed to a control damper comprising a line of blades each of which is so supported for rotation in a surrounding frame that the blades are swingable about parallel axes to open or close an opening in the frame and to be movable at will to intermediate positions between their fully-open and fully-closed positions, in which the blades are of aerofoil shape.

Preferably the blades are of hollow construction and are each formed by bending a rectangular sheet of metal such as stainless steel to blade shape with two opposite edges of the sheet joined together to form the trailing edge of the blade. By providing low-profile aspect ratio aerofoil blades in a control damper, the invention ensures a minimum of air resistance, turbulence and noise during the flow of air or other gaseous fluid through the damper.

The invention also extends to novel means for effecting swinging movement of the blades about their parallel axes, such means comprising intermeshing gear wheels—one for each blade—which can be rotated in unison to cause corresponding unitary swinging movement of the blades between their fully-open and fully-closed positions.

Two examples of control dampers in accordance with the invention are shown in the accompanying drawings, in which.

Figure 1:
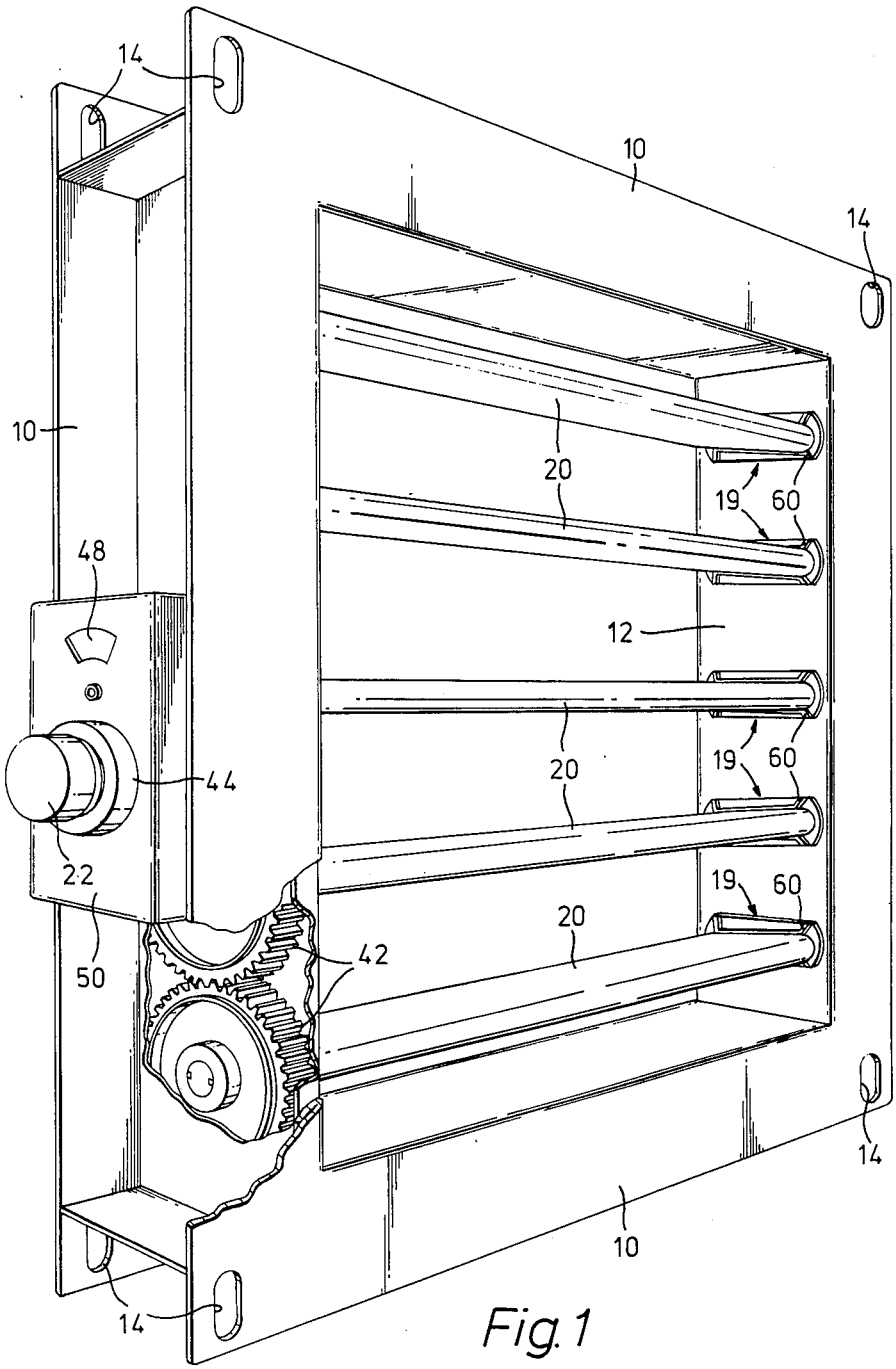
FIG. 1 is a perspective view of one form of damper with a small portion shown in section.
Figure 12:
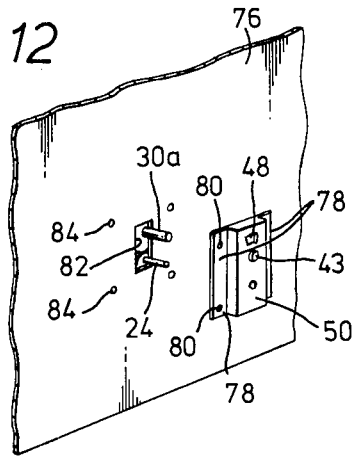
Figure 9:
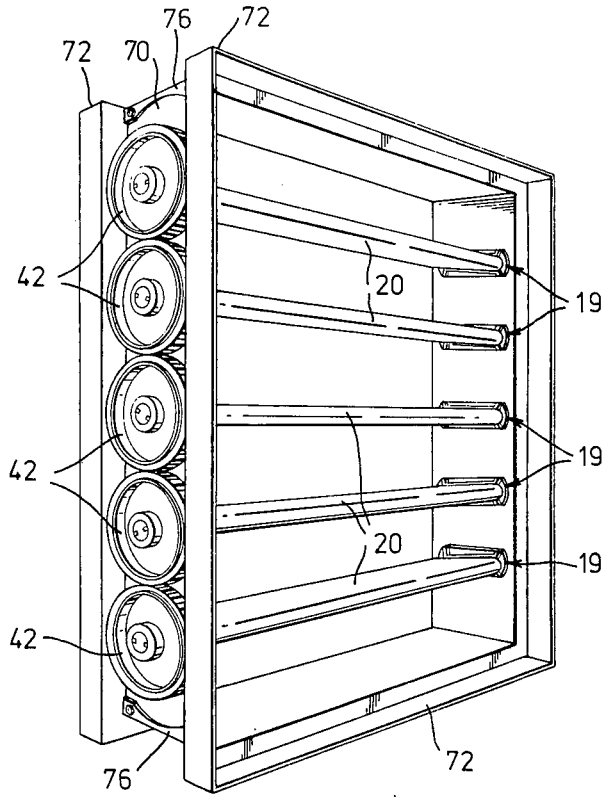
Figure 8:
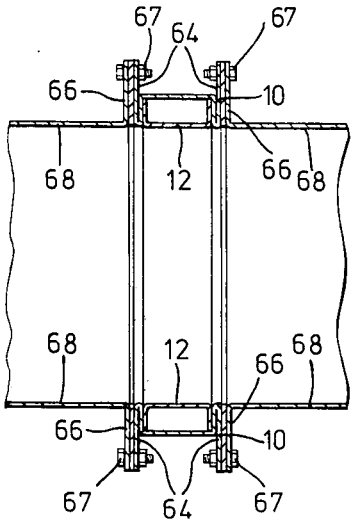
FIG. 8 is a sectional view, on a reduced scale, showing the damper frame of FIG. 1 mounted in an air duct.
Figure 11:
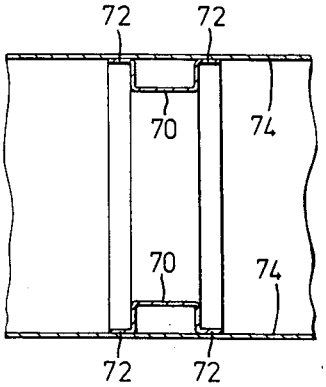
Figure 10:
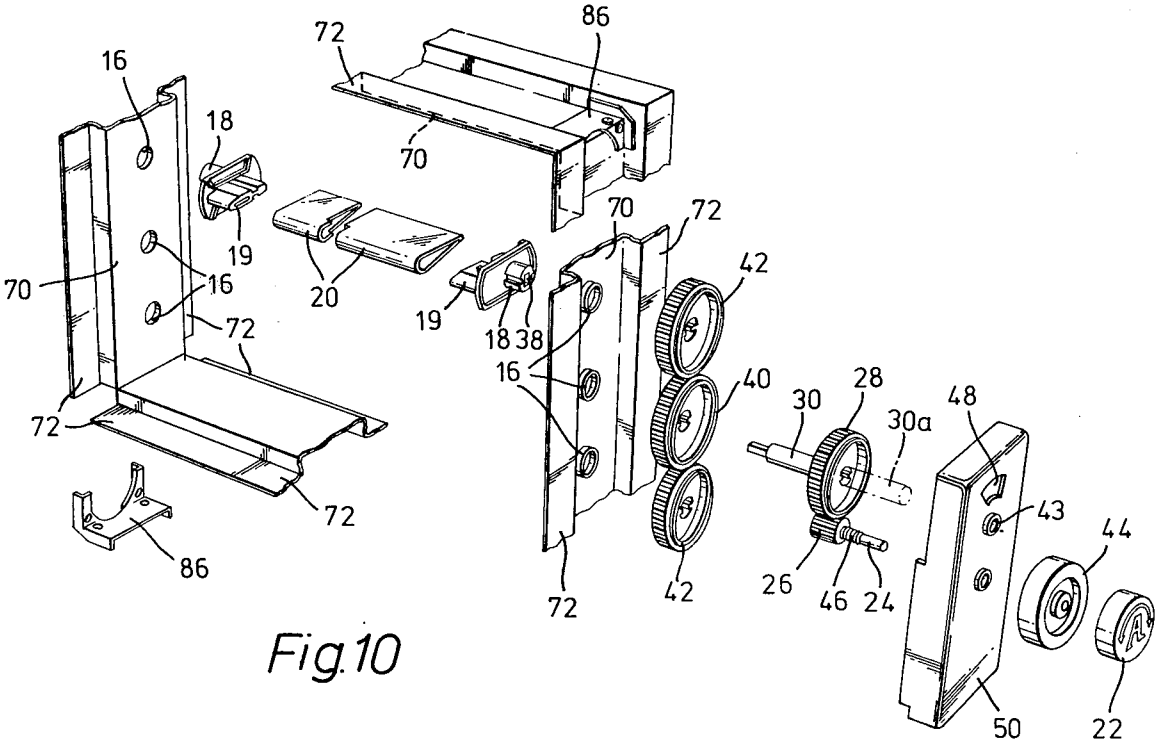

FIGS. 9, 10 and 11 are views corresponding to FIGS. 1, 1 and 8 of a second form of damper; and FIG. 12 is a perspective view illustrating a modification to the damper of FIGS. 9 and 10.

Figure 2:
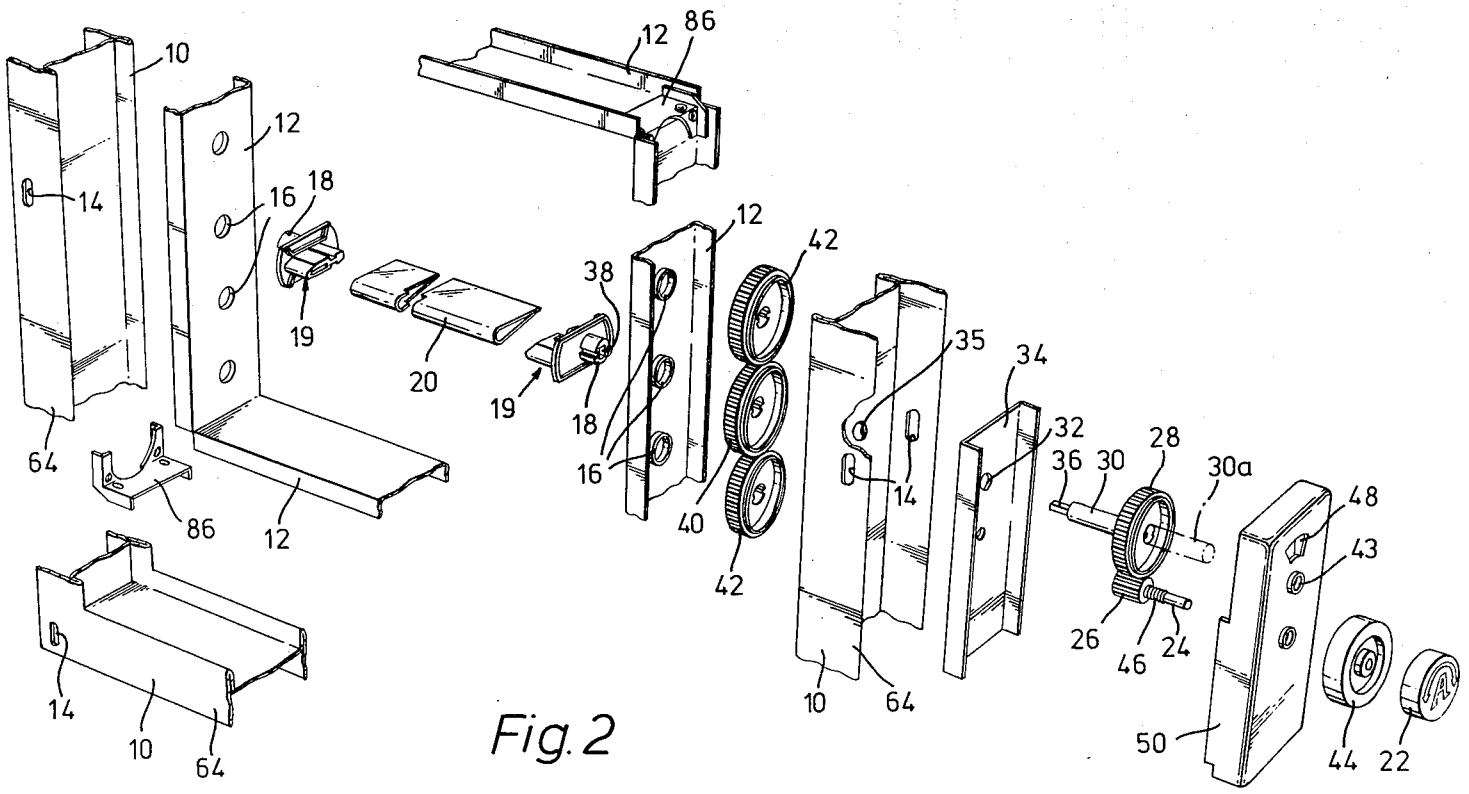
FIG. 2 is an exploded view in perspective of part of the damper shown in FIG. 1.

The control damper shown in FIGS. 1 and 2 comprises a roll-formed galvanised sheet steel outer frame 10 of girder section and a sheet steel inner frame 12. The outer frame 10 has continuously-welded corners and has elongated holes 14 punched in it to permit the damper to be bolted to the flanges of an air duct and to be adjusted for height on those flanges. The attachment by welding, bolting, rivetting, or other means of the inner and outer frames together produces a double-skin air-tight casing of high rigidity and substantial strength.

As will be seen from FIG. 2, the inner frame 12 has a series of circular holes 16 which are so punched in its two vertical sides that the holes 16 have a length greater than the actual thickness of the metal. The holes 16 support the shafts 18 of blade bearing components 19 which fit into and onto the open ends of blades 20 which are thus mounted for rotation in the frame about parallel axes. The blades 20 are low-profile aspect ratio aerofoil stainless steel blades to provide low resistance to air or other gaseous fluid flowing through the damper, especially when the blades are in their fully-open positions (i.e. the positions of the blades shown in FIG. 1 of the drawings). The aerofoil section of the blades also reduces turbulence and noise and provides excellent protection against corrosion resulting from the presence of corrosive particles in the air stream. Another advantage is that the narrow blade width readily permits the withdrawal of the complete damper from a duct, regardless of the positions of the blades within the damper casing, without materially disturbing the flow of air through the duct frame as a whole.

Rotation of the blades about their respective axes can be effected either manually or through power-operated means. In FIG. 2, a manually-rotated control knob 22 mounted on the outside of the outer frame 10 has a shaft 24 fixed to it, and this shaft is provided with a small gear wheel 26 meshing with a larger gear wheel 28 on a shaft 30 to provide a low-torque 4:1 reduction gear. The shaft 30 passes through a hole 32 in a baseplate 34 attached to the outer frame 10. The hole 32 is in alignment with a hole 35 in the outer frame 10 so as to permit the keyed end 36 of the shaft 30 to enter a rectangular-section hole 38 in the shaft 18 of one of the blade bearing components 19. In so doing, the shaft 30 passes through a gear wheel 40 which is keyed onto the same shaft 18. Each blade has a respective gear wheel 42 of the same diameter and construction as the said gear wheel 40, the gear wheels 42 and the gear wheel 40 being arranged in meshing engagment and disposed in a line vertically of the damper.

Where it is desired to rotate the blades by power-operated means, the shaft 30 can be made longer as shown by the broken-line extension 30*a* in FIG. 2 so that the said extension projects a substantial distance outside a cover plate 50 or some other supporting plate. That then permits the extension 30*a* of the shaft 30 to be coupled or otherwise connected to an hydraulic, pneumatic, electric or electro-magnetic motor (not shown) to permit the motor to turn the shaft 30. An advantage of using such a motor is that remote control of the blades then becomes possible. Except in those rare cases where both manual and power-operation of the shaft 30 is desired, the shaft 24 and the gear wheels 26 and 28 will not be provided if the shaft 30 is coupled to a motor.

It will therefore be seen that, by rotating the knob 22 to rotate the gear wheel 26 and thus the gear wheel 28, or, alternatively, by actuating a motor coupled to an extension 30*a* of the shaft 30, the shaft 30 will be made to rotate the particular blade 20 to which it is connected as well as the gear wheel 40. Rotation of the gear wheel 40 will cause rotation of all the gear wheels 42 so that all the blades 20 will move together about their respective axes. However, alternate gear wheels 40, 42 will rotate in opposite senses so that adjacent pairs of blades will likewise rotate in opposite senses or directions to open or close the central passage through the damper according to which way the shaft 30 is rotated.

In order to lock the blades in a selected setting where rotation of the shaft 30 is effected manually, a cylindrical locking nut 44 is provided on the shaft 24 which carries a screwthread 46 for this purpose. A window 48 is also provided adjacent the knob 22 on the cover plate 50 so that the setting of the blades between their fully-open and their fully-closed positions can be observed, as well as the direction in which the leading edges of the blades are facing with respect to the direction of the air-flow in the duct. Where rotation of the shaft 30 is effected by a motor, the motor itself can be provided with suitable locking means to lock the shaft, and therefore the blades, in a selected setting. Also, visual indicating means can be associated with a moving part of the motor to indicate the positions of the blades.

In order that the various gears and bearings may be quiet in operation and have high strength, low weight and long life with self-lubricating properties, the gear wheels and bearings are preferably all made of a self-lubricating synthetic plastics material such as molybdenum disulphide-impregnated nylon or polyester. Such gear wheels and bearings can be precision-moulded and are then totally enclosed and completely shut off from the air stream through the damper by the outer and inner frames 10 and 12. This ensures that the gear wheels and bearings do not become dirty or contaminated with impurities in the air stream.

Figure 7:
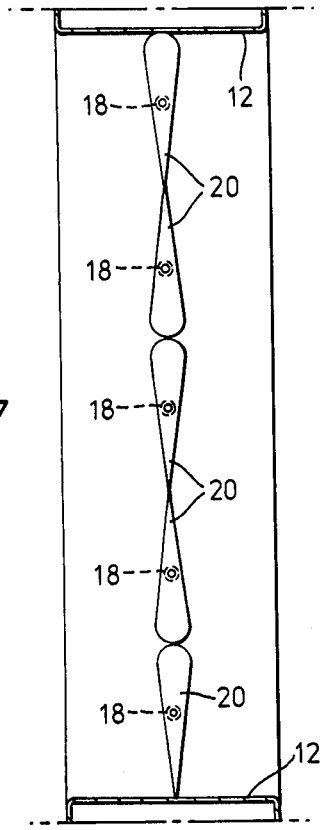
FIG. 7 is a diagrammatic sectional view showing the blades in their closed positions.

The extent to which the blades can be rotated about their respective axes can be varied to suit the requirements of different customers. Normally they will be rotatable through 360° to provide for maximum flexibility in use. Such a construction is illustrated in FIG. 7, the blades being shown therein in their fully-closed positions.

Figure 3:
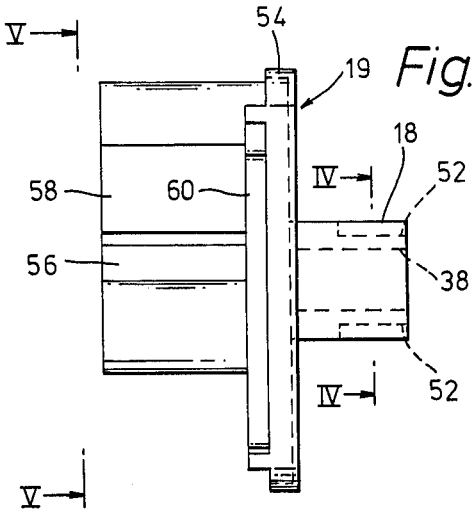
FIG. 3 is an enlarged side view of a bearing component for supporting an end of a blade.
Figure 4:
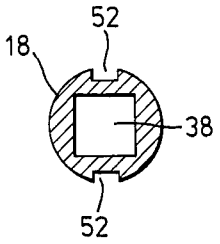
FIG. 4 is a section taken on the line IV—IV in FIG. 3.
Figure 5:
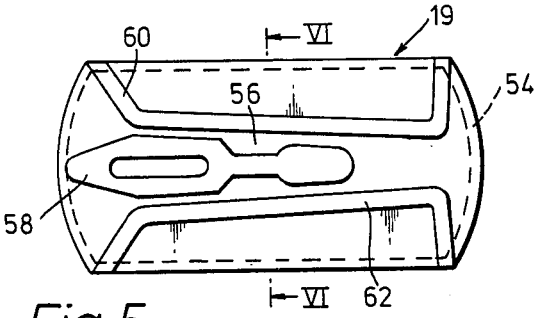
FIG. 5 is an end view of the bearing component as seen from the line V—V in FIG. 3.
Figure 6:
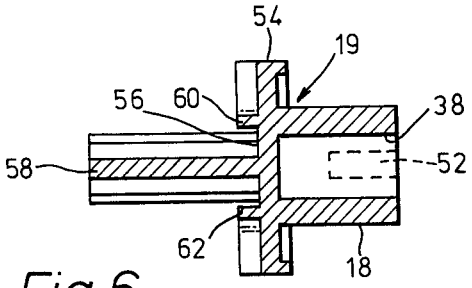
FIG. 6 is a section taken on the line VI—VI in FIG. 5.

FIGS. 3–6 illustrate the detailed construction of the blade bearing components 19 which support the ends of the blades 20. As already described above, the shaft 18 of each component 19 has a rectangular-section hole 38 so that any selected one of the components 19 can be used to receive the keyed end 36 of the shaft 30. The keying of the gear wheels 40 and 42 on their respective shafts 18 is effected by providing each shaft 18 with two longitudinally-extending external slots 52 as shown in FIGS. 3 and 4, the said gear wheels being provided with internal keys which enter those slots to lock the gear wheels against rotation on their shafts.

The shaft 18 of each component 19 leads up to an intermediate flange 54 on the component which forms a surface 56 opposing the adjacent end of its respective blade 20. Projecting from that surface 56 of the flange 54 is a spigot 58 which is specially shaped in cross-section (see FIG. 5) to enter the adjacent open end of the blade 20 and to support that end of the blade for rotation about an axis parallel to the leading and trailing edges of the blade. A pair of ridges 60 and 62 are also formed on the flange 54 of the blade bearing component to receive the extreme end-portion of the blade between them. These ridges give additional support to the blade end and also give the latter a neat appearance while having a beneficial sealing effect.

The damper illustrated in FIGS. 1–7 is designed to be inserted in a duct by having the flanges 64 of the outer casing 10 bolted to corresponding flanges 66 of the duct by bolts 67 as shown in FIG. 8. In other words, the damper is inserted in a "break" in the duct so that the inner frame 12 is substantially flush with the internal surfaces 68 of the duct. However, in certain countries—particularly the United States of America—it is customary to position dampers entirely within a duct. FIGS. 9 and 10 illustrate a damper having a frame 70 which permits this to be done. The frame 70 is, in effect, the same as the inner frame 12 in FIG. 2 except that the frame 70 has flanges 72 which lie against the inner surface 74 of a duct as shown in FIG. 11. The duct itself therefore forms an outer frame for the damper so that the outer frame 10 of FIG. 1 is no longer needed. Apart from this and the omission of the base-plate 34 shown in FIG. 2, the damper shown in FIGS. 9 and 10 is essentially the same as that shown in FIGS. 1–7, and the same reference numerals have been applied to like parts.

FIG. 12 illustrates a small modification to the damper shown in FIGS. 9 and 10 in that the cover plate 50 is designed to be screwed or bolted to the outside of a duct 76, the cover plate having a pair of flanges 78 with bolt or screw holes 80 in it to permit this to be done. A small window 82 is cut in the wall of the duct 76 to allow the shafts 24 and/or 30*a* to project through that wall and thus enter the cover plate 50. Screw or bolt holes 84 are also provided in the duct wall to match the holes 80 in the flanges 78.

In order to strengthen the inner frame 12 of FIG. 2 and the frame 70 of FIGS. 10 and 11, metal corner pieces 86 are welded, rivetted or otherwise fixed to the corners of those frames.

What is claimed is:

1. A control damper for controlling the flow of gaseous fluid through a duct, said control damper comprising: a hollow metal frame defining an opening for the passage of fluid therethrough, a line of hollow, sheet-steel, aerofoil-section, open-ended blades arranged in said opening of said frame, a plurality of blade bearing components, one at each end of each blade, to support the blades on said frame for rotation about parallel axes extending longitudinally of the blades, said blades being swingable about said axes to open and close the said opening in the frame and to be movable at will to intermediate positions between fully-open and fully-closed positions, a shaft on each blade bearing component and a respective aperture in said frame to rotatably receive said shaft, an intermediate flange on each blade bearing component, a surface on said flange opposing the adjacent open end of the respective blade, a spigot projecting from said flange surface and shaped in cross-section to enter the said adjacent open end of the blade and to support that end of the blade for rotation about the longitudinal axis of the blade, a pair of spaced-apart flange-like ridges projecting from said flange surface of said blade bearing component to receive the extreme end-portion of the blade between them, the ridges being in snug contact with said extreme end-portion, to give additional support to the blade end, and a plurality of rotary elements, one for each blade, keyed onto the blade bearing components at one side of said frame for the purpose of effecting swinging movement of the blades about their parallel axes, the said rotary elements being rotatable in unison to cause corresponding swinging movement of the blades between their fully-open and fully-closed positions.

2. A control damper according to claim 1, wherein said frame comprises a roll-formed galvanized sheet-steel outer frame of girder section and a sheet-steel inner frame, said outer and inner frames being firmly attached to each other to produce a double-skin air-tight casing of high rigidity and substantial strength.

3. A control damper for controlling the flow of gaseous fluid through a duct, said control damper comprising: a hollow metal frame defining an opening for the passage of fluid therethrough, a line of hollow, sheet-steel, aerofoil-section, open-ended blades arranged in said opening of said frame, a plurality of blade bearing components, one at each end of each blade, to support the blades on said frame for rotation about parallel axes extending longitudinally of the blades, said blades being swingable about said axes to open and close the said opening in the frame and to be movable at will to intermediate positions between fully-open and fully-closed positions, a shaft on each blade bearing component and a respective aperture in said frame to rotatably receive said shaft, an intermediate flange on each blade bearing component, a surface on said flange opposing the adjacent open end of the respective blade, a pair of spaced-apart flange-like ridges projecting from said flange surface of said blade bearing component to receive the extreme end-portion of the blade between them, the ridges being in snug contact with said extreme end-portion, and a plurality of rotary elements, one for each blade, keyed onto the blade bearing components at one side of said frame for the purpose of effecting swinging movement of the blades about their parallel axes, the said rotary elements being rotatable in unison to cause corresponding swinging movement of the blades between their fully-open and fully-closed positions.

4. A control damper according to claim 3 wherein said frame comprises a roll-formed galvanized sheet-steel outer frame of girder section and a sheet-steel inner frame, said outer and inner frames being firmly attached to each other to produce a double-skin air-tight casing of high rigidity and substantial strength.

* * * * *